US010170071B2

(12) United States Patent
Yamamoto

(10) Patent No.: US 10,170,071 B2
(45) Date of Patent: Jan. 1, 2019

(54) DISPLAY APPARATUS

(71) Applicant: Japan Display Inc., Tokyo (JP)

(72) Inventor: Go Yamamoto, Tokyo (JP)

(73) Assignee: Japan Display Inc., Tokyo (JP)

( * ) Notice: Subject to any disclaimer, the term of this patent is extended or adjusted under 35 U.S.C. 154(b) by 45 days.

(21) Appl. No.: 15/422,928

(22) Filed: Feb. 2, 2017

(65) Prior Publication Data

US 2017/0243558 A1 Aug. 24, 2017

(30) Foreign Application Priority Data

Feb. 23, 2016 (JP) ..... 2016-032226

(51) Int. Cl.
*G09G 3/36* (2006.01)

(52) U.S. Cl.
CPC ..... *G09G 3/3696* (2013.01); *G09G 3/3677* (2013.01); *G09G 3/3648* (2013.01); *G09G 2300/043* (2013.01); *G09G 2320/0646* (2013.01); *G09G 2320/0666* (2013.01); *G09G 2330/00* (2013.01); *G09G 2330/02* (2013.01); *G09G 2330/026* (2013.01); *G09G 2330/027* (2013.01)

(58) Field of Classification Search
CPC ..... G09G 2300/043; G09G 2320/0646; G09G 2320/0666; G09G 2330/00; G09G 3/3677; G09G 3/3696; G09G 5/001; G09G 3/2092; G09G 3/3648; G09G 2330/02; G09G 2330/026; G09G 2330/027
See application file for complete search history.

(56) References Cited

U.S. PATENT DOCUMENTS

2014/0015823 A1* 1/2014 Suh ..... G09G 5/001 345/212
2015/0293388 A1 10/2015 Tanaka et al.
2017/0243532 A1* 8/2017 Huang ..... G09G 3/2092

FOREIGN PATENT DOCUMENTS

JP 2015-203-803 A 11/2015

* cited by examiner

*Primary Examiner* — Richard Hong
(74) *Attorney, Agent, or Firm* — K&L Gates LLP

(57) ABSTRACT

According to an aspect, a display apparatus includes: a display device that displays an image; and a drive circuit that drives the display device. The display device includes a regulator that supplies power based on a predetermined set voltage, a plurality of functional blocks that are operated by the supply of the power from the regulator and are related to operation of the display device, a voltage monitoring circuit that determines whether a level of a power supply voltage of at least one of the functional blocks is high or low based on a predetermined threshold voltage, and a voltage controller that increases the set voltage when the voltage monitoring circuit determines that the power supply voltage of the functional block is lower than the threshold voltage.

4 Claims, 10 Drawing Sheets

DISPLAY APPARATUS

CROSS-REFERENCE TO RELATED APPLICATIONS

This application claims priority from Japanese Application No. 2016-032226, filed on Feb. 23, 2016, the contents of which are incorporated by reference herein in its entirety.

BACKGROUND

1. Technical Field

The present invention relates to a display apparatus.

2. Description of the Related Art

For example, display apparatuses, such as a liquid crystal display apparatus described in Japanese Patent Application Laid-open Publication No. 2015-203803, includes a plurality of pixels driven to display an image. Such a display apparatus includes a driver integrated circuit (IC) for such display driving.

In recent years, the resolution of the display apparatus and the number of functions thereof have increased, which has caused increase in the number of functions and extension of functions implemented in a drive circuit such as the driver IC. The increase in the number of functions leads to an increase in power consumption of the drive circuit. At the same time, there is a demand for reduction in the power consumption of the drive circuit.

Among drive circuits provided with a plurality of functional blocks to perform a plurality of functions with one drive circuit, some have functional blocks that are operable at substantially the same voltage and share a power supply voltage. Such a configuration allows sharing a common regulator that supplies power at a voltage required to operate the functional blocks. However, in the functional blocks that share the power supply voltage in this way, the power supply voltage is reduced by power consumption associated with operation of the at least one of the functional blocks. In such a configuration, when the power supply voltage drops to a level lower than the lower limit value of the voltage required to operate the functional blocks, the functional blocks malfunction or become inoperative. Although such a problem has been previously predictable, countermeasures are more and more required in consideration of the increase in the power consumption associated with, for example, the increase in the number of functions.

As a simple countermeasure, it is possible to design the regulator such that the regulator can supply power at the highest voltage permissible for the functional blocks to reduce the possibility of reduction in the power supply voltage to a level lower than the lower limit value of the voltage required to operate the functional blocks. However, the power consumption of the drive circuit increases with increase in the voltage, so that it is difficult to reduce the power consumption of the drive circuit.

For the foregoing reasons, there is a need for a display apparatus that can both ensure voltages required to operate a plurality of functional blocks and restrain increase in power consumption.

SUMMARY

According to an aspect, a display apparatus includes: a display device that displays an image; and a drive circuit that drives the display device. The display device includes a regulator that supplies power based on a predetermined set voltage, a plurality of functional blocks that are operated by the supply of the power from the regulator and are related to operation of the display device, a voltage monitoring circuit that determines whether a level of a power supply voltage of at least one of the functional blocks is high or low based on a predetermined threshold voltage, and a voltage controller that increases the set voltage when the voltage monitoring circuit determines that the power supply voltage of the functional block is lower than the threshold voltage.

DETAILED DESCRIPTION

Figure 1:
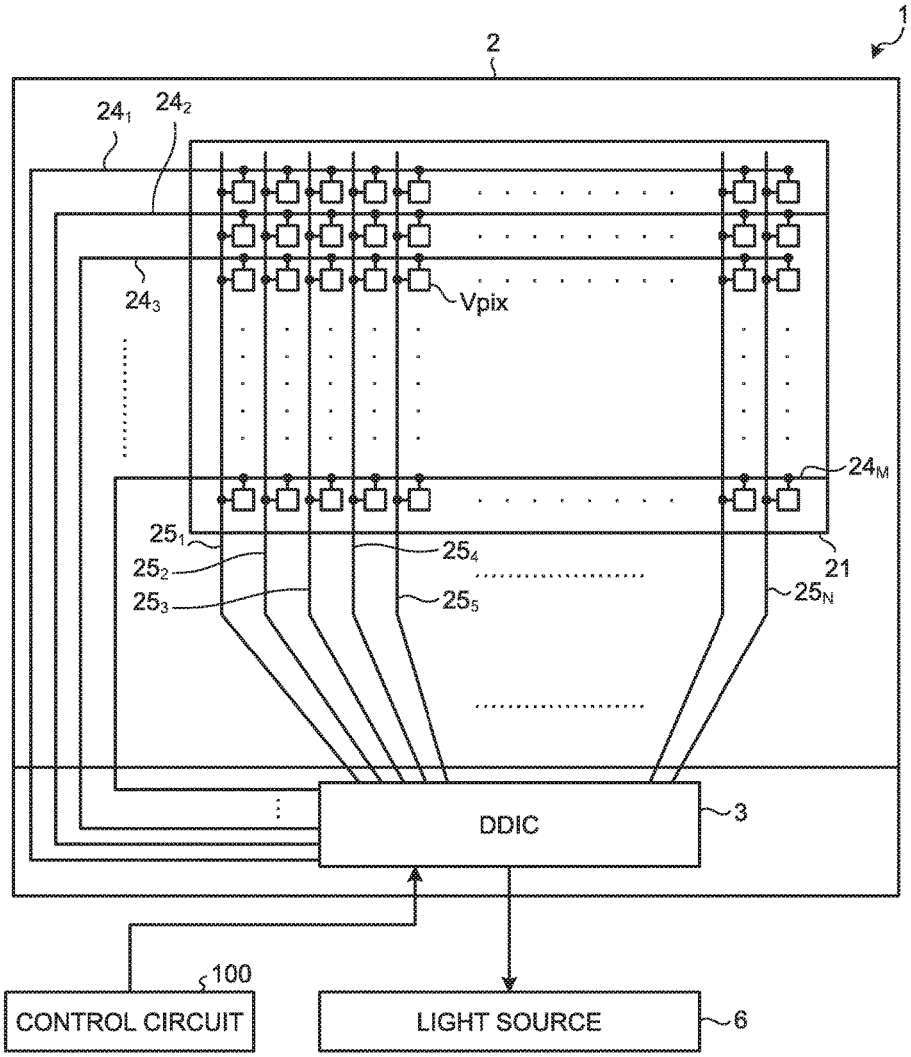
FIG. 1 is a block diagram illustrating a system configuration example of a display apparatus according to an embodiment.

Following describes an embodiment of the present invention with reference to the drawings. The disclosure is merely an example, and the present invention naturally encompasses appropriate modifications easily conceivable by those skilled in the art while maintaining the gist of the invention. To further clarify the description, widths, thicknesses, shapes, and the like of various components may be schematically illustrated in the drawings as compared with actual aspects thereof. However, they are merely examples, and interpretation of the invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

Figure 2:
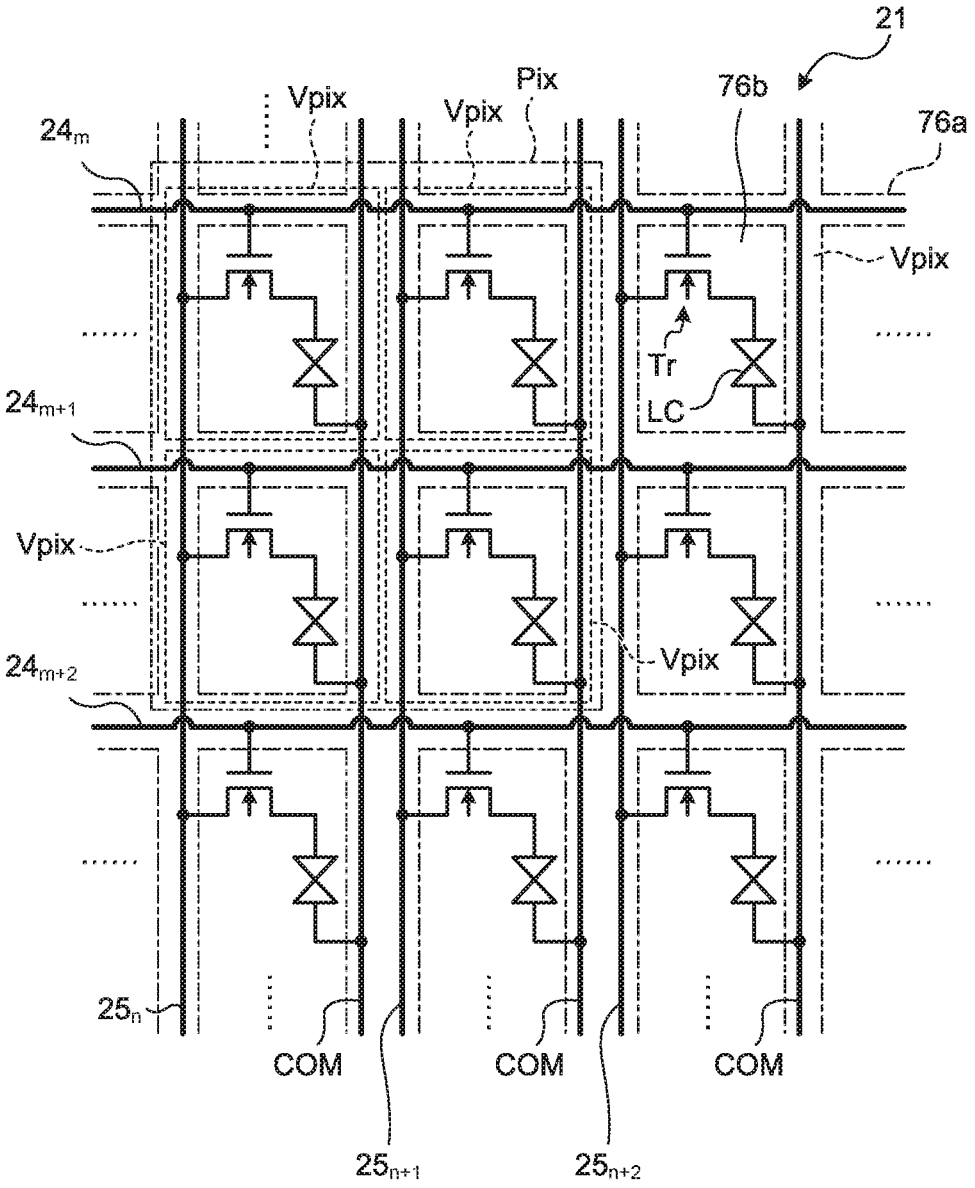
FIG. 2 is a circuit diagram illustrating a drive circuit that drives pixels of the display apparatus according to the embodiment.

FIG. 1 is a block diagram illustrating a system configuration example of a display apparatus 1 according to a present embodiment. FIG. 2 is a circuit diagram illustrating a drive circuit that drives pixels Pix of the display apparatus 1 according to the present embodiment. The display apparatus 1 is, for example, a transmissive liquid crystal display apparatus, and includes a display panel 2, a display driver integrated circuit (DDIC) 3, and a light source 6.

The display panel 2 serves as a display device for displaying an image. Specifically, the display panel 2 includes, for example, a light-transmitting insulating substrate, such as a glass substrate, and a display area 21 that is located on a surface of the glass substrate and is provided with a large number of pixels Pix including liquid crystal cells (refer to FIG. 2) arranged in a matrix. The glass substrate includes a first substrate on which a plurality of pixel circuits including active elements (such as transistors) are arranged in a matrix and a second substrate opposite to the first substrate with a predetermined gap interposed therebetween. The gap between the first and second substrates is maintained at the predetermined distance by photo spacers that are arranged at various places on the first substrate. The gap between the first and second substrates is filled with a liquid crystal. The arrangements and sizes of components, such as the display area 21, of the display panel 2 illustrated in FIG. 1 are only schematic, and do not reflect the actual arrangements and sizes thereof.

The display area 21 has a matrix structure in which sub-pixels Vpix including a liquid crystal layer are arranged in M rows×N columns. In this specification, the row refers to a pixel row including N sub-pixels Vpix arranged in one direction, and the column refers to a pixel column that includes M sub-pixels Vpix. The pixel columns are arranged in a direction orthogonal to an arrangement direction of the pixel rows. The values of M and N are determined according to a display resolution in the vertical direction and a display resolution in the horizontal direction. The display area 21 includes scanning lines $\mathbf{24}_1$, $\mathbf{24}_2$, $\mathbf{24}_3$, . . . , $\mathbf{24}_M$ on a row-by-row basis and signal lines $\mathbf{25}_1$, $\mathbf{25}_2$, $\mathbf{25}_3$, . . . , $\mathbf{25}_N$ on a column-by-column basis, with respect to the M rows×N columns array of the sub-pixels Vpix. Hereinafter, in some cases in the present embodiment, the scanning lines $\mathbf{24}_1$, $\mathbf{24}_2$, $\mathbf{24}_3$, . . . , $\mathbf{24}_M$ will be collectively denoted as scanning lines 24, and the signal lines $\mathbf{25}_1$, $\mathbf{25}_2$, $\mathbf{25}_3$, . . . , $\mathbf{25}_N$ will be collectively denoted as signal lines 25. Also in the present embodiment, any three of the scanning lines $\mathbf{24}_1$, $\mathbf{24}_2$, $\mathbf{24}_3$, . . . , $\mathbf{24}_M$ will be denoted as scanning lines $\mathbf{24}_m$, $\mathbf{24}_{m+1}$, and $\mathbf{24}_{m+2}$ (where m is a natural number satisfying $m \leq M-2$), and any four of the signal lines $\mathbf{25}_1$, $\mathbf{25}_2$, $\mathbf{25}_3$, . . . , $\mathbf{25}_N$ will be denoted as signal lines $\mathbf{25}_n$, $\mathbf{25}_{n+1}$, $\mathbf{25}_{n+2}$, and $\mathbf{25}_{n+3}$ (where n is a natural number satisfying $n \leq N-3$).

The DDIC 3 is a circuit that is mounted on the glass substrate of the display panel 2, for example, by a chip-on-glass (COG) process. The DDIC 3 is coupled with, for example, an external control circuit 100 and an external input power supply through a flexible printed circuit (FPC) board (not illustrated). The control circuit 100 transmits various signals related to operation of the display apparatus 1 to the DDIC 3. The external input power supply supplies power required for operation of the DDIC 3 through, for example, a connection terminal 41 (to be described later). The control circuit 100 is a circuit included in an electronic apparatus provided with the display apparatus 1, for example.

Figure 3:
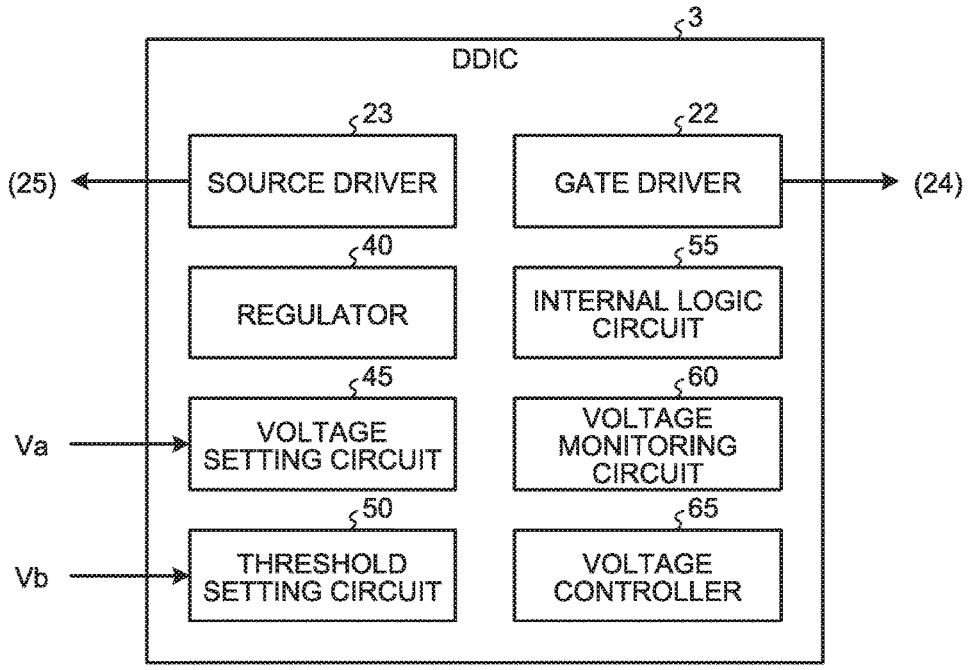
FIG. 3 is a block diagram illustrating a functional configuration example of a display driver integrated circuit (DDIC)

FIG. 3 is a block diagram illustrating a functional configuration example of the DDIC 3. The DDIC 3 is a drive circuit for driving the display device. Specifically, the DDIC 3 includes, for example, a gate driver 22, a source driver 23, a regulator 40, a voltage setting circuit 45, a threshold setting circuit 50, an internal logic circuit 55, a voltage monitoring circuit 60, and a voltage controller 65, and outputs various signals related to the display of the image to be performed by the display device to operate the display device.

More specifically, the DDIC 3 operates the display device, for example, according to the various signals supplied from the control circuit 100. The control circuit 100 outputs, for example, a master clock signal, a horizontal synchronizing signal, a vertical synchronizing signal, and a display image signal to the DDIC 3. The DDIC 3 performs synchronous control of the gate driver 22 and the source driver 23 based on, for example, these signals.

In synchronization with the vertical synchronizing signal and the horizontal synchronizing signal, the gate driver 22 latches digital data on a per horizontal period basis according to the horizontal synchronizing signal. The gate driver 22 sequentially outputs the latched digital data for one line as a vertical scan pulse to be supplied to each of the scanning lines 24 (scanning lines $\mathbf{24}_1$, $\mathbf{24}_2$, $\mathbf{24}_3$, . . . , $\mathbf{24}_M$) of the display area 21 so as to sequentially select the sub-pixels Vpix row by row. The gate driver 22 sequentially outputs the digital data to the scanning lines 24 in the order of the scanning lines $\mathbf{24}_1$, $\mathbf{24}_2$, . . . , that is, in the order from one end side to the other end side of the display area 21. The gate driver 22 can alternatively sequentially output the digital data to the scanning lines 24 in the order of the scanning lines $\mathbf{24}_M$, $\mathbf{24}_{M-1}$, . . . , that is, in the order from the other end side to the one end side of the display area 21.

The source driver 23 is supplied with 8-bit digital data of, for example, four colors (such as red (R), green (G), blue (B), and white (W)) that have been generated based on the display image signal through processing of, for example, the internal logic circuit 55 (to be described later). The source driver 23 writes display data to the sub-pixels Vpix in a row selected by the vertical scanning performed by the gate driver 22 through the signal lines 25 (signal lines $\mathbf{25}_1$, $\mathbf{25}_2$, $\mathbf{25}_3$, . . . , $\mathbf{25}_N$), one sub-pixel at a time, a plurality of sub-pixels at a time, or all the sub-pixels at a time.

Known driving methods for a liquid crystal display panel include a line inversion driving method, a dot inversion driving method, and a frame inversion driving method. The line inversion driving method is a driving method in which the polarity of a video signal is inverted at a time period of 1H (H is a horizontal period) corresponding to one line (one pixel row). The dot inversion driving method is a driving method in which the polarity of the video signal is alternately inverted between sub-pixels adjacent to each other in two intersecting directions (such as in the row and column directions). The frame inversion driving method is a driving method in which the polarity of video signals to be written to all the sub-pixels for one frame corresponding to one screen is inverted at once into the same polarity. The display apparatus 1 can employ any of the driving methods described above.

In the description of the present embodiment, the M scanning lines $\mathbf{24}_1$, $\mathbf{24}_2$, $\mathbf{24}_3$, . . . , $\mathbf{24}_M$ are collectively referred to as the scanning lines 24 in some cases. The scanning lines $\mathbf{24}_m$, $\mathbf{24}_{m+1}$, and $\mathbf{24}_{m+2}$ in FIG. 2 are some of the M scanning lines $\mathbf{24}_1$, $\mathbf{24}_2$, $\mathbf{24}_3$, . . . , $\mathbf{24}_M$. The N signal lines $\mathbf{25}_1$, $\mathbf{25}_2$, $\mathbf{25}_3$, . . . , $\mathbf{25}_N$ are collectively referred to as the signal lines 25 in some cases. The signal lines $\mathbf{25}_n$, $\mathbf{25}_{n+1}$, and $\mathbf{25}_{n+2}$ in FIG. 2 are some of the N signal lines $\mathbf{25}_1$, $\mathbf{25}_2$, $\mathbf{25}_3$, . . . , $\mathbf{25}_N$.

Wiring is arranged in the display area 21, the wiring including the signal lines 25 and the scanning lines 24. The signal lines 25 supply pixel signals as the display data to thin-film transistor (TFT) elements Tr of the sub-pixels Vpix. The scanning lines 24 drive the TFT elements Tr. In this manner, the signal lines 25 extend in a plane parallel to the surface of the glass substrate described above, and supply the pixel signals for displaying the image to the sub-pixels Vpix. Each of the sub-pixels Vpix includes corresponding one of the TFT elements Tr and a liquid crystal element LC. The TFT element Tr includes a thin-film transistor such as an n-channel metal oxide semiconductor (MOS) TFT. One of the source and the drain of the TFT element Tr is coupled with the signal line 25, the gate thereof is coupled with the scanning line 24, and the other of the source and the drain thereof is coupled with the liquid crystal element LC. One end of the liquid crystal element LC is coupled with the other of the source and the drain of the TFT element Tr, and the other end of the liquid crystal element LC is coupled with a common electrode COM. A drive electrode driver (not illustrated) applies a drive signal to the common electrode COM. The drive electrode driver may be one component of the DDIC 3, or may be an independent circuit.

The sub-pixel Vpix is coupled with the other sub-pixels Vpix belonging to the same row of the display area 21 through the corresponding scanning line 24. The scanning line 24 is coupled with the gate driver 22 and supplied with the vertical scan pulse of the scan signal from the gate driver 22. The sub-pixel Vpix is also coupled with the other sub-pixels Vpix belonging to the same column of the display area 21 through the corresponding signal line 25. The signal line 25 is coupled with the source driver 23, and supplied with the pixel signal from the source driver 23. The sub-pixel Vpix is further coupled with the other sub-pixels Vpix belonging to the same column of the display area 21 through the corresponding common electrode COM. The common electrode COM is coupled with the drive electrode driver (not illustrated), and is supplied with the drive signal from the drive electrode driver.

The gate driver 22 applies the vertical scan pulse to the gates of the TFT elements Tr of the sub-pixels Vpix through the scanning lines 24 so as to sequentially select, as a target of display driving, each row (one horizontal line) among the sub-pixels Vpix formed in a matrix in the display area 21. The source driver 23 supplies the pixel signals, through the signal lines 25, to the respective sub-pixels Vpix included in one horizontal line sequentially selected by the gate driver 22. These sub-pixels Vpix display one horizontal line according to the supplied pixel signals.

As described above, in the display apparatus 1, the gate driver 22 drives the scanning lines 24 so as to sequentially scan them, and thereby sequentially selects one horizontal line. In the display apparatus 1, the source driver 23 supplies the pixel signals, through the signal lines 25, to the sub-pixels Vpix belonging to the selected one horizontal line so as to perform the display on a per horizontal line basis. The drive electrode driver is configured to apply the drive signal to the common electrode COM corresponding to the horizontal line when the display operation is performed.

The display area 21 includes a color filter. The color filter includes a black matrix 76*a* having a grid shape and openings 76*b*. The black matrix 76*a* is formed so as to cover the outer circumferences of the sub-pixels Vpix as illustrated in FIG. 2. That is, the black matrix 76*a* is disposed at boundaries between the two-dimensionally arranged sub-pixels Vpix so as to have the grid shape. The black matrix 76*a* is formed of a material having a high light absorption factor. The openings 76*b* are openings formed by the grid shape of the black matrix 76*a* and are arranged corresponding to the sub-pixels Vpix.

The openings 76*b* include color regions corresponding to sub-pixels for outputting four colors. Specifically, the openings 76*b* include color regions colored, for example, in three colors of red (R), green (G), and blue (B) as an example of a set of a first color, a second color, and a third color, and color regions of a fourth color (such as white (W)). The color regions colored, for example, in the three colors of red (R), green (G), and blue (B) are periodically arranged at the openings 76*b* of the color filter. When the fourth color is white (W), the coloring by the color filter is not applied to the openings 76*b* for white (W). When the fourth color is other than white, the color employed as the fourth color is produced by the color filter. In the present embodiment, one set of sub-pixels Vpix corresponding to four colors including R, G, and B and the fourth color (such as W) corresponds to one pixel Pix as illustrated in FIG. 2. In this manner, the display panel 2 includes a plurality of pixels (pixels Pix) in which the sub-pixels (sub-pixels Vpix) for outputting red (R), green (G), blue (B), and the fourth color (such as white (W)) are arranged, and serves as a display pixel portion having a display area (such as the display area 21) in which the pixels are arranged in a matrix. In the present embodiment, an input image signal for one pixel is specifically an input image signal corresponding to an output of the single pixel Pix that includes the sub-pixels Vpix of red (R), green (G), blue (B), and the fourth color (white (W)). Hereinafter, red (R), green (G), blue (B), and white (W) will be simply referred to as R, G, B, and W in some cases. Also, a combination of red (R), green (G), and blue (B) will be referred to as RGB in some cases. Further, a combination of red (R), green (G), blue (B), and white (W) will be referred to as RGBW in some cases.

The color filter may have a combination of other colors as long as being colored in different colors from each other. The color region of green (G) of the color filter has generally higher luminance than that of the color regions of red (R) and blue (B). When the fourth color is white (W), a light-transmitting resin may be used as the color filter to provide the white color.

In the display area 21, the scanning lines 24 and the signal lines 25 are arranged in a region overlapping the black matrix 76*a* of the color filter when viewed from a direction orthogonal to the front side of the display area part 21. That is, the scanning lines 24 and the signal lines 25 are hidden behind the black matrix 76*a* when viewed from the direction orthogonal to the front side. A region of the display area 21 where the black matrix 76*a* is not disposed serves as the opening 76*b*.

Figure 4:
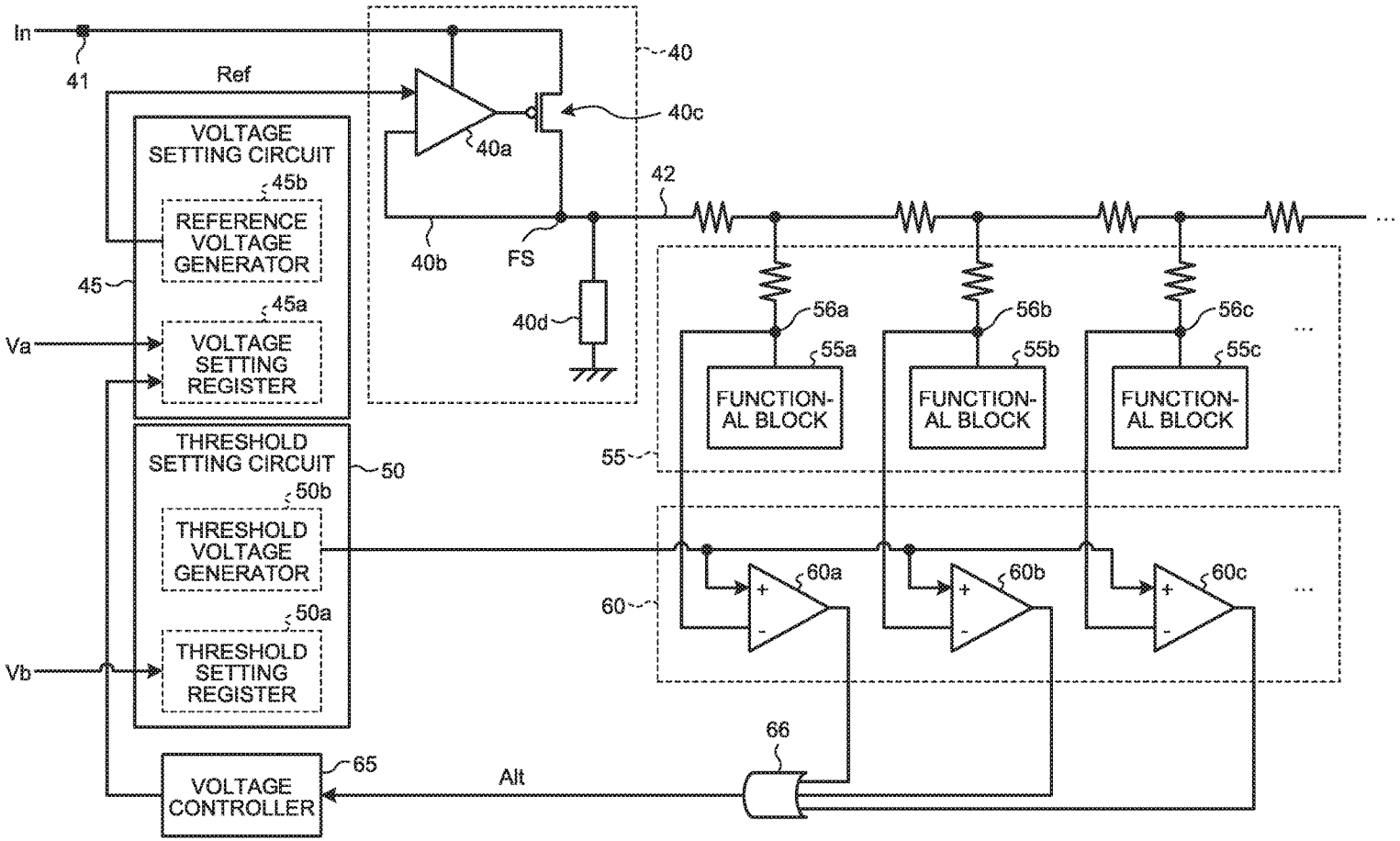
FIG. 4 is a schematic circuit diagram illustrating an example of a regulator and components related to operation of the regulator.

FIG. 4 is a schematic circuit diagram illustrating an example of the regulator 40 and components related to operation of the regulator 40. The regulator 40 supplies power based on a predetermined set voltage. Specifically, the regulator 40 is provided between the connection terminal 41 of the external input power supply coupled with the DDIC 3 and a power supply line 42 for supplying power to the internal logic circuit. The regulator 40 supplies power to the power supply line 42 by applying a voltage corresponding to the set voltage to the power supply line 42 based on the power supplied from the external input power supply through the connection terminal 41. More specifically, the regulator 40 includes an operational amplifier 40*a* that controls a transistor in a wiring line that couples the connection terminal 41 with the power supply line 42. The output end of the operational amplifier 40*a* is coupled with the gate terminal of a p-channel MOS (Pch MOS) transistor 40*c*. The Pch MOS transistor 40*c* is interposed between the connection terminal 41 of the external input power supply and the power supply line 42 for supplying the power to the internal logic circuit. The source terminal of the Pch MOS transistor 40*c* is coupled with the connection terminal 41 to be externally supplied with a predetermined power supply voltage. The drain terminal of the Pch MOS transistor 40*c* serves as the output end of the regulator 40 and is coupled with the power supply line 42, and the output from the drain terminal is fed back into an input side of the operational amplifier 40*a* (negative feedback). That is, the output from the drain terminal of the Pch MOS transistor 40*c* is fed back into the non-inverting input terminal (positive terminal) of the operational amplifier 40*a* via a junction FS coupled with the power supply line 42. A load 40*d* is coupled with the output end of the operational amplifier 40*a*. Examples of the load 40*d* include, but are not limited to, a resistor and a capacitor. A reference voltage (Ref) corresponding to the set voltage set in the voltage setting circuit 45 is supplied to the inverting input terminal (negative terminal) of the operational amplifier 40*a*. The negative feedback path enters the non-inverting input terminal (positive terminal) of the operational amplifier 40*a* because the drain terminal of the Pch MOS transistor 40*c* serves as the output end of the regulator 40. However, if the output is obtained from, for example, a source follower, the negative feedback path enters the inverting input terminal (negative terminal), and the reference voltage (Ref) is supplied to the non-inverting input terminal (positive terminal) of the operational amplifier 40*a*. The operational amplifier 40*a* compares the voltages represented by the two inputs with each other, and performs control so as to output, to the power supply line 42, a direct-current (DC) voltage according to the transfer function of the reference voltage (Ref) and the negative feedback path (feedback loop 40*b*). In this example, the negative feedback path directly couples the output end of the regulator 40 with the input terminal of the operational amplifier 40*a*. The negative feedback path is, however, not limited to this example, but the gain thereof can be appropriately set using a resistor or another element.

The voltage setting circuit 45 sets an initial value of the set voltage of the regulator 40. Specifically, the voltage setting circuit 45 includes, for example, a voltage setting register 45*a* and a reference voltage generator 45*b*. The voltage setting register 45*a* stores a value (Va) representing the set voltage. The reference voltage generator 45*b* generates the reference voltage (Ref) representing the set voltage corresponding to the value (Va) stored in the voltage setting register 45*a*, and outputs the reference voltage (Ref) to the positive terminal of the operational amplifier 40*a* included in the regulator 40. The voltage setting circuit 45 may generate and a reference signal that indicates the reference voltage (Ref) and output the reference signal to the regulator 40, and the regulator 40 may convert the reference signal into the reference voltage (Ref) to be input to the positive terminal of the operational amplifier 40*a*.

The initial value of the value (Va) representing the set voltage is output from the control circuit 100 to the DDIC 3, for example. The value (Va) that represents the set voltage and is stored in the voltage setting register 45*a* can be rewritten by the voltage controller 65.

The threshold setting circuit 50 sets a threshold voltage for determining the level of the power supply voltage for at least one of functional blocks 55*a*, 55*b*, 55*c*, . . . (which will be described later) that fluctuates according to power consumption. Specifically, the threshold setting circuit 50 includes, for example, a threshold setting register 50*a* and a threshold voltage generator 50*b*. The threshold setting register 50*a* stores a value corresponding to a threshold voltage (Vb) output from the control circuit 100 to the DDIC 3. The threshold voltage generator 50*b* supplies the threshold voltage (Vb) corresponding to the value stored in the threshold setting register 50*a* to the voltage monitoring circuit 60. The threshold setting circuit 50 may generate a threshold signal that indicates the threshold voltage (Vb) and output the threshold signal to the voltage monitoring circuit 60, and the voltage monitoring circuit 60 may convert the threshold signal into the threshold voltage (Vb) to be used therein.

The threshold voltage is a value depending on the initial value of the value (Va) representing the set voltage that is output from the control circuit 100 to the DDIC 3, and is a value determined within a voltage range appropriate for operation of the internal logic circuit 55. The set voltage is determined within a voltage range desirable for the operation of the internal logic circuit 55. The set voltage is preferably set to the lower limit value of voltage at which the internal logic circuit 55 can operate.

As a specific example, a supply voltage (In) to be supplied from the external input power supply through the connection terminal 41 is set to be substantially equal to 1.8 [V], and the voltage range appropriate for the operation of the internal logic circuit 55 is set to be from 1.0 [V] to 1.4 [V]. In this case, for example, the initial value of the set voltage of the regulator 40 is set to be substantially equal to 1.2 [V], and the threshold voltage of the voltage monitoring circuit 60 is set to be substantially equal to 1.1 [V]. These values are merely examples, and are not limited thereto, but can be changed as appropriate.

The internal logic circuit 55 includes a plurality of functional blocks that are related to the operation of the display device and operated by the supply of the power from the regulator 40. The functional blocks are, for example, functional blocks 55*a*, 55*b*, 55*c*, . . . . The functional blocks 55*a*, 55*b*, 55*c*, . . . included in the internal logic circuit 55 share the voltage applied to the power supply line 42 by the supply of power from the regulator 40. Specifically, the internal logic circuit 55 includes the functional blocks 55*a*, 55*b*, 55*c*, . . . that are coupled with, for example, a plurality of branch lines branching off the power supply line 42. In FIG. 4 and other figures, reference characters are assigned to the functional blocks, such as functional blocks 55*a*, 55*b*, 55*c*, . . . , in the order from a functional block coupled with a branch line branching at a location closer to the upstream side of a power supply route of the power supply line 42. The number of the functional blocks illustrated in FIG. 4 and other figures is three. This is, however, merely an example. The number of the functional blocks is not limited thereto, but only needs to be two or larger. The function of each of the functional blocks 55*a*, 55*b*, 55*c*, . . . will be described later.

The functional blocks (such as the functional blocks 55*a*, 55*b*, 55*c*, . . . ) are configured to operate according to the display of the image performed by the display device. Each of the functional blocks 55*a*, 55*b*, 55*c*, . . . consumes power while being in operation. That is, a current flows through the power supply line 42 when at least one of the functional blocks 55*a*, 55*b*, 55*c*, . . . operates. Since the power supply line 42 has a parasitic resistance, the current reduces the voltage of the power supply line 42. The level of the reduction in the voltage of the power supply line 42 depends on the level of the power consumption amount of the functional blocks 55*a*, 55*b*, 55*c*, . . . . The voltage drop of the power supply line 42 increases as the power consumption of functional blocks in operation among the functional blocks

55*a*, 55*b*, 55*c*, . . . is larger, and also increases as the number of functional blocks in operation among the functional blocks 55*a*, 55*b*, 55*c*, . . . is larger.

In the present embodiment, the regulator 40 is operated by feedback control. Hence, the current consumption of functional blocks (at least one of the functional blocks 55*a*, 55*b*, 55*c*, . . . ) does not reduce the voltage at the junction FS of the feedback. It is, however, difficult to avoid a drop in the voltage due to a current flowing through, for example, the parasitic resistance of the wiring line (power supply line 42) from the junction FS of the feedback to these functional blocks. Consequently, if the drop in the voltage causes the voltage of the power supply line 42 to become lower than the minimum voltage required for the operation of the functional blocks 55*a*, 55*b*, 55*c*, . . . , these functional blocks cannot sufficiently operate in some cases. In consideration of such a problem, in the present embodiment, the voltage monitoring circuit 60 monitors the voltage, and the voltage controller 65 controls the set voltage.

The voltage monitoring circuit 60 determines the level of the power supply voltage of at least one of the functional blocks 55*a*, 55*b*, 55*c*, . . . based on the predetermined threshold voltage. That is, the voltage monitoring circuit 60 determines whether the level of the voltage of wiring lines between at least one of the functional blocks 55*a*, 55*b*, 55*c*, . . . and the regulator 40 is high or low. Specifically, the voltage monitoring circuit 60 includes, for example, a plurality of comparing circuits (such as comparing circuits 60*a*, 60*b*, 60*c*, . . . ). Each of the comparing circuits 60*a*, 60*b*, 60*c*, . . . is, for example, a comparator. Each of the comparing circuits 60*a*, 60*b*, 60*c*, . . . compares a voltage of a branch line coupled with corresponding one of the functional blocks with the threshold voltage (Vb) output from the threshold voltage generator 50*b*, and produces an output according to the result of the comparison. In this manner, the voltage monitoring circuit 60 of the present embodiment includes a plurality of such comparators, each of which determines whether the level of the power supply voltage is higher or lower than a predetermined voltage. The respective comparators monitor the voltages of wiring lines between the functional blocks 55*a*, 55*b*, 55*c*, . . . and the regulator 40, each of the wiring lines being coupled with different one of the functional blocks. In the following description of the present embodiment, the voltage supplied to each of the functional blocks 55*a*, 55*b*, 55*c*, . . . will be referred to as "internal logic voltage" in some cases.

In the present embodiment, the threshold voltage (Vb) output from the threshold voltage generator 50*b* is supplied to the positive terminal of each of the comparators included in the voltage monitoring circuit 60, and the voltages corresponding to respective branch points of the branch lines coupled with the functional blocks 55*a*, 55*b*, 55*c*, . . . are supplied to the negative terminals of the respective comparators. If the voltage corresponding to the branch point of the branch line is lower than the threshold voltage (Vb), the output of the comparator is set to High. If the voltage corresponding to the branch point of the branch line is equal to or higher than the threshold voltage (Vb), the output of the comparator is set to Low.

In the case of the example illustrated in FIG. 4, the outputs of the comparators (comparing circuits 60*a*, 60*b*, 60*c*, . . . ) are combined by an OR logic circuit 66 to obtain an output (Alt) of the voltage monitoring circuit 60. The OR logic circuit 66 is provided such that output lines of the comparing circuits 60*a*, 60*b*, 60*c*, . . . included in the voltage monitoring circuit 60 are coupled with the input side of the OR logic circuit 66. That is, if an output of at least one of the comparing circuits 60*a*, 60*b*, 60*c*, . . . included in the voltage monitoring circuit 60 is High, the output (Alt) of the voltage monitoring circuit 60 is set to High, or if every output is Low, the output (Alt) of the voltage monitoring circuit 60 is set to Low. That is, when the voltage monitoring circuit 60 determines that at least one of the internal logic voltages is lower than the threshold voltage (Vb), the output (Alt) of the voltage monitoring circuit 60 is set to High.

FIG. 4 and other figures illustrate examples in which electrical resistances are provided on the power supply line 42 and the branch lines branching off the power supply line 42. FIG. 4 and other figures, however, merely schematically illustrate resistances (parasitic resistances) electrically generated between the regulator 40 and the functional blocks 55*a*, 55*b*, 55*c*, . . . , and do not illustrate a specific circuit layout. Such parasitic resistances are preferably not present between junctions 56*a*, 56*b*, 56*c*, . . . that acquire voltages of the branch lines supplied to the comparators included in the voltage monitoring circuit 60 and the functional blocks 55*a*, 55*b*, 55*c*, . . . . When the parasitic resistances are not present, change in the voltage of the branch lines associated with the operations of the functional blocks 55*a*, 55*b*, 55*c*, . . . can be more accurately reflected in the output of the comparators.

The voltage controller 65 controls the set voltage based on the determination result of the voltage monitoring circuit 60. Specifically, the voltage controller 65 controls the set voltage according to whether the output (Alt) of the voltage monitoring circuit 60 is High or Low. For example, if the output (Alt) of the voltage monitoring circuit 60 is High, the voltage controller 65 rewrites the value of the voltage setting register 45*a* so as to increase the set voltage. That is, the voltage controller 65 increases the set voltage when the voltage monitoring circuit 60 determines that a voltage of at least one of the functional blocks 55*a*, 55*b*, 55*c*, . . . is lower than the threshold voltage.

When the voltage of at least one of the functional blocks 55*a*, 55*b*, 55*c*, . . . is held equal to or higher than the threshold voltage for a predetermined period of time after the set voltage has been increased by the voltage controller 65, the voltage controller 65 reduces the set voltage. Specifically, after the increasing processing performed at the latest time, the voltage controller 65 of the present embodiment performs monitoring processing to determine whether the output (Alt) of the voltage monitoring circuit 60 continues to be Low for an image-display output period for n frames (nVSYNV) that is defined based on the vertical synchronizing signals. If the monitoring processing determines that the output (Alt) of the voltage monitoring circuit 60 has continued to be Low for the image-display output period for n frames (nVSYNV), the voltage controller 65 determines that the internal logic voltage has been determined to have been held equal to or higher than the threshold voltage for the predetermined period of time after the set voltage has been increased by the voltage controller 65, and reduces the set voltage. The "predetermined period of time" used for the determination of reducing the set voltage is not limited to the image-display output period for n frames (nVSYNV), but may be any period.

When changing the set voltage, the voltage controller 65 in the present embodiment changes the set voltage in a predetermined voltage value steps (such as in 0.05 [V] steps). That is, if the output (Alt) of the voltage monitoring circuit 60 turns to High, the voltage controller 65 performs processing (increasing processing) to increase the value (Va) that represents the set voltage and is stored in the voltage setting register 45*a* by 0.05. If the monitoring processing determines that the output (Alt) of the voltage monitoring circuit 60 has continued to be Low for the image-display output period for n frames (nVSYNV), the voltage controller 65 performs processing (reducing processing) to reduce the value (Va) representing the set voltage by 0.05.

The voltage applied by the regulator 40 to the power supply line 42 corresponds to the set voltage. Therefore, the voltage controller 65 controls the set voltage to control the voltage applied to the power supply line 42. For example, if the output (Alt) of the voltage monitoring circuit 60 turns to High, the internal logic voltage is determined to have decreased to a value lower than the threshold voltage associated with the operation of at least one of the functional blocks 55*a*, 55*b*, 55*c*, . . . . . In this case, the voltage controller 65 increases the set voltage, and thus can reduce the possibility that the internal logic voltage continues to be lower than the threshold voltage. This can reduce the possibility of malfunction of the functional blocks 55*a*, 55*b*, 55*c*, . . . . If, instead, the output (Alt) of the voltage monitoring circuit 60 continues to be Low for a predetermined period of time (such as nVSYNC), the internal logic voltage is determined to have continued to be equal to or higher than the threshold voltage. In this case, the voltage controller 65 reduces the set voltage to prevent power supply at an unnecessarily high voltage, and thus can restrain increase in power consumption. In this manner, according to the present embodiment, the voltages required to operate the functional blocks 55*a*, 55*b*, 55*c*, . . . can be ensured, and the power consumption can be restrained from increasing.

The voltage controller 65 controls the set voltage of the regulator 40 within the voltage range appropriate for the operation of the internal logic circuit 55. For example, the upper limit of the set voltage is a maximum voltage (Max at, for example, 1.4 [V]) at which the functional blocks 55*a*, 55*b*, 55*c*, . . . have been verified to operate properly. In the present embodiment, the lower limit voltage of the set voltage is the first set voltage (initial value) before the voltage controller 65 has increased the set voltage. Specifically, if, for example, the initial value of the set voltage is 1.2 [V], the lower limit of the set voltage to be reduced by the reducing processing after being increased by the increasing processing is 1.2 [V]. The voltage controller 65 performs the increasing processing, under the conditions described above, according to the time when the output (Alt) of the voltage monitoring circuit 60 turns to High. The voltage controller 65 monitors the period of time while the output (Alt) of the voltage monitoring circuit 60 is Low after the increasing processing, on a basis of per predetermined period of time, and performs the reducing processing according to the result of the monitoring, under the conditions described above.

A specific example will be described below. Assume that the voltage range appropriate for the operation of the internal logic circuit 55 is set to be from 1.0 [V] to 1.4 [V]; the initial value of the set voltage of the regulator 40 is set to be substantially equal to 1.2 [V]; and the threshold of the voltage monitoring circuit 60 is set to be substantially equal to 1.1 [V]. In this case, when the voltage of any one of the junctions 56*a*, 56*b*, 56*c*, . . . becomes equal to or lower than the threshold voltage substantially equal to 1.1 V, and the output (Alt) of the voltage monitoring circuit 60 turns to High, the voltage controller 65 performs the increasing processing (+0.05) to increase the set voltage to a value substantially equal to 1.25 [V]. If, thereafter, the output (Alt) of the voltage monitoring circuit 60 turns to High again before the predetermined period of time (such as nVSYNC) elapses, the voltage controller 65 performs the increasing processing (+0.05) again to increase the set voltage to a value substantially equal to 1.3 [V]. When the increasing processing is performed a plurality of times, the increasing processing is performed so that the set voltage on which the increasing processing is performed does not exceed the upper limit of the voltage range appropriate for the operation of the internal logic circuit 55. Specifically, the upper limit of the set voltage is set to the maximum voltage (Max at, for example, 1.4 [V]) at which the functional blocks 55*a*, 55*b*, 55*c*, . . . have been verified to operate properly. In other words, if an additional increasing processing is expected to cause the set voltage to exceed the upper limit, the additional increasing processing is not performed even when the output (Alt) of the voltage monitoring circuit 60 has turned to High again. After the increasing processing is performed one or more times, if the output (Alt) of the voltage monitoring circuit 60 continues to be Low for the predetermined period of time (nVSYNC), and the set voltage is higher than the initial value (1.2 [V]), the voltage controller 65 performs the reducing processing to reduce the set voltage. For example, after the set voltage is increased to a value substantially equal to 1.3 [V], if the output (Alt) of the voltage monitoring circuit 60 continues to be Low for the predetermined period of time (nVSYNC), the voltage controller 65 performs the reducing processing (−0.05) to reduce the set voltage to a value substantially equal to 1.25 [V]. If, thereafter, the output (Alt) of the voltage monitoring circuit 60 continues to be Low for the additional predetermined period of time (nVSYNC), the voltage controller 65 performs the reducing processing (−0.05) again to reduce the set voltage to a value substantially equal to 1.2 [V]. Even if, thereafter, the output (Alt) of the voltage monitoring circuit 60 continues to be Low for the additional predetermined period of time (nVSYNC), the voltage controller 65 does not reduce the set voltage to a value lower than the initial value (1.2 [V]). The voltage step by which the set voltage is increased or reduced is not limited to 0.05 V, but can be set to an appropriate voltage value according to the system.

Figure 5:
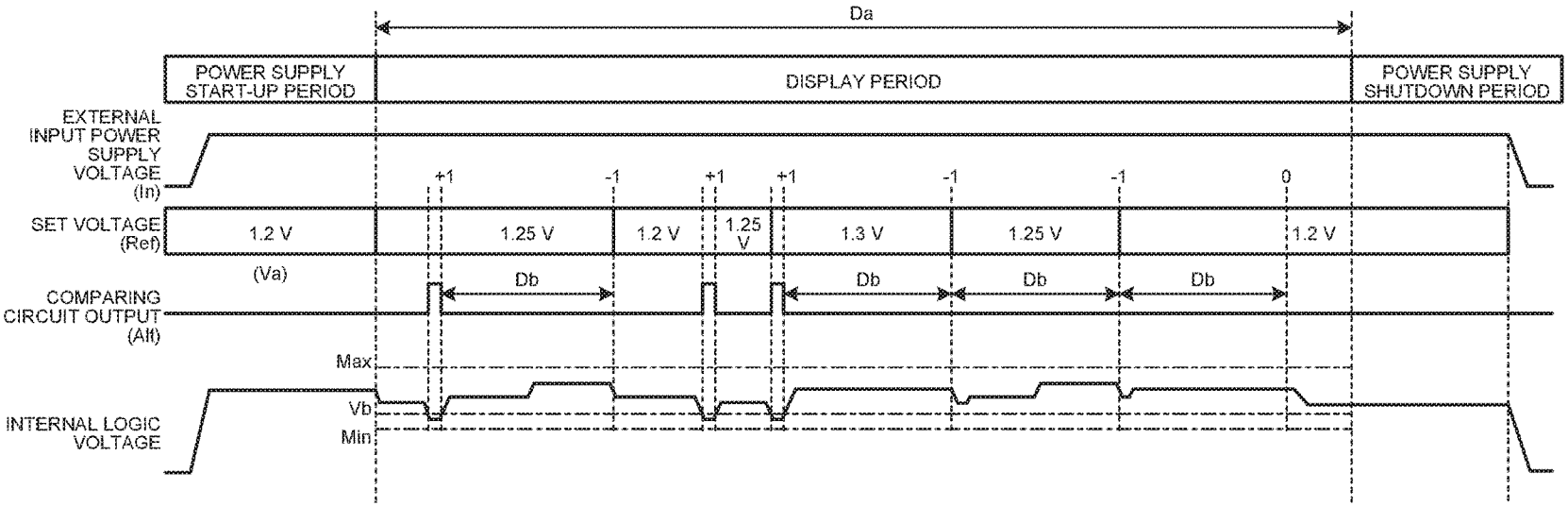
FIG. 5 is a timing diagram illustrating an example of control of a set voltage associated with operation of the display apparatus.

FIG. 5 is a timing diagram illustrating an example of the control of the set voltage associated with operation of the display apparatus. Starting to supply power from the external input power supply starts the operation of the display apparatus 1. In a power supply start-up period immediately after the display apparatus 1 has started operating, the set voltage is set to a value (such as 1.2 [V]) according to the initial value (Va at, for example, 1.2 [V]) of the set voltage that is output from the control circuit 100 to the DDIC 3. The regulator 40 operates based on the reference voltage output (Ref) representing the set voltage, and as a result, the internal logic voltage is controlled to be a voltage corresponding to the set voltage.

During the power supply start-up period, the threshold voltage is set in the threshold setting circuit 50 according to the threshold voltage (Vb at, for example, 1.1 [V]) of the voltage monitoring circuit 60 output from the control circuit 100 to the DDIC 3. During the power supply start-up period, the display device displays no image, and the functional blocks 55*a*, 55*b*, 55*c*, . . . included in the internal logic circuit 55 do not operate. Due to this, no current flows through the parasitic resistance of the power supply line 42, and no voltage drop occurs. Hence, the internal logic voltage is substantially 1.2 V. As a result, all the outputs of the comparing units 60*a*, 60*b*, 60*c*, . . . are Low, and hence, the output (Alt) of the voltage monitoring circuit 60 is Low.

After the power supply start-up period has shifted to a display period, and the display device starts displaying an image, the internal logic voltage drops associated with the operation of at least one of the functional blocks 55*a*, 55*b*,

55*c*, . . . included in the internal logic circuit 55. The output (Alt) of the voltage monitoring circuit 60 is set to High at the time when the internal logic voltage becomes lower than the predetermined threshold voltage (Vb). According to this timing, the voltage controller 65 performs the increasing processing once to increase the set voltage by one step. This increasing processing increases the set voltage by one step (for example, from 1.2 [V] to 1.25 [V]).

After performing the increasing processing, the voltage controller 65 monitors the period of time while the output (Alt) of the voltage monitoring circuit 60 is Low on a basis of per predetermined period of time (Db, such as nVSYNC), and performs the reducing processing based on the result of the monitoring. In FIG. 5, after the set voltage is increased by one step to a value substantially equal to 1.25 [V], the internal logic voltage is maintained at a voltage equal to or higher than the predetermined threshold voltage (Vb) for the predetermined period of time (Db) or longer. Thus, when the voltage of every one of the junctions 56*a*, 56*b*, 56*c*, . . . is equal to or higher than the threshold voltage of the voltage monitoring circuit 60 at the time when the output (Alt) of the voltage monitoring circuit 60 has continued to be Low for the predetermined period of time (Db), the voltage controller 65 performs the reducing processing once to reduce the set voltage by one step. This reducing processing reduces the set voltage by one step (for example, from 1.25 [V] to 1.2 [V]).

In FIG. 5, Da denotes the display period, and Db denotes the predetermined period of time in which the voltage monitoring circuit 60 performs the monitoring. A relation Da≥Db holds. In FIG. 5, the symbol "+1" represents that the set voltage is "increased by one step" by one-time execution of the increasing processing, and the symbol "−1" represents that the set voltage is "reduced by one step" by one-time execution of the reducing processing. The symbol "0" represents that, although a condition for allowing the reducing processing to be performed is satisfied, the reducing processing is omitted because the set voltage has been reduced to the lower limit (such as 1.2 [V]) to which the reducing processing is allowed reduce the set voltage.

If, thereafter, the internal logic voltage becomes lower than the predetermined threshold voltage (Vb), the voltage controller 65 performs the increasing processing once at that time to increase the set voltage in a stepwise manner, and thus increases the set voltage of the regulator 40 to a value substantially equal to 1.25 V. Furthermore, if, while the set voltage of the regulator 40 is substantially 1.25 V, the voltage of any one of the junctions 56*a*, 56*b*, 56*c*, . . . becomes equal to or lower than the threshold voltage of the voltage monitoring circuit 60, the increasing processing is performed for the second time to increase the set voltage to a value substantially equal to 1.30 V. In FIG. 5, the increasing processing is performed twice to increase the set voltage by two steps (for example, from 1.2 [V] to 1.25 [V], then to 1.3 [V]). If, thereafter, the voltage of every one of the junctions 56*a*, 56*b*, 56*c*, . . . is equal to or higher than the threshold voltage of the voltage monitoring circuit 60 at the time when the output (Alt) of the voltage monitoring circuit 60 has continued to be Low for the predetermined period of time (Db), the reducing processing is performed to reduce the set voltage in a stepwise manner. In FIG. 5, the one-time reducing processing is performed to reduce the set voltage by one step (for example, from 1.3 [V] to 1.25 [V]) after the set voltage has been set to a value substantially equal to 1.3 [V]. If, thereafter, the output (Alt) of the voltage monitoring circuit 60 has continued to be Low for the predetermined period of time (Db), the reducing processing is additionally performed to reduce the set voltage of the regulator 40 by one step (for example, from 1.25 [V] to 1.2 [V]). In the present embodiment, the lower limit of the set voltage is substantially 1.2 [V]. Therefore, even if, thereafter, the output (Alt) of the voltage monitoring circuit 60 continues to be Low for the predetermined period of time (Db) or longer, the reducing processing is not performed. After the first of the two increasing processing operations from 1.2 [V] to 1.25 [V] and then to 1.3 [V], the period in which the output (Alt) of the voltage monitoring circuit 60 is Low is monitored. However, the internal logic voltage becomes lower than the predetermined threshold voltage (Vb) before the predetermined period of time (Db) elapses. As a result, the increasing processing is performed again, and the monitoring time of the predetermined period of time (Db) is reset.

If, thereafter, operation termination processing of the display apparatus 1 starts, a power supply shutdown period starts. During the power supply shutdown period, the internal logic voltage decreases along with the termination of power supply from the external input power supply. In the power supply shutdown period, the functional blocks 55*a*, 55*b*, 55*c*, . . . have stopped operating.

The following describes the functional blocks 55*a*, 55*b*, 55*c*, . . . . Specific exemplary functions provided by the internal logic circuit 55 using the functional blocks include, for example, a backlight control function, a color enhancement function, and the WhiteMagic™ function. Each of the functional blocks 55*a*, 55*b*, 55*c*, . . . is an intellectual property core (IP core), namely, an internal control circuit that is implemented so as to perform any one of such functions. In the present embodiment, for example, the functional block 55*a* is an IP core for the backlight control function; the functional block 55*b* is an IP core for the color enhancement function; and the functional block 55*c* is an IP core for the WhiteMagic™ function. These functional blocks 55*a*, 55*b*, and 55*c* illustratively described in the present embodiment are merely specific examples of the functional blocks 55*a*, 55*b*, 55*c*, . . . , and are not intended to limit the functional blocks in the present invention. The functions of the functional blocks in the present invention can include functions that can be implemented in an integrated manner in the drive circuit at present and in the future.

The backlight control function is a function to control the light source 6 according to the display of the image by the display device. Specifically, the light source 6 is controlled by the backlight control function so as to be lit up during the display period (refer to FIG. 5). The backlight control function may include a function to reflect luminance control of the light source 6 performed by the color enhancement function and/or the WhiteMagic™ function.

The color enhancement function is a function related to adjustment of color tone in the display of the image performed by the display device. Specifically, the color enhancement function provides, to the display apparatus 1, a function to display the image in a color tone according to a preset of colors selected from presets of one pattern or a plurality of patterns of colors registered in advance. The color enhancement function may include a function to register a preset of a new pattern of colors.

The WhiteMagic™ function is a function related to control of light of a white component in the display of the image performed by the display device. Specifically, for example, a combination of gradation values of red (R), green (G), and blue (B) represented by input image signals in an RGB color space can be handled as image signals in an RGBW color space by handling R, G, and B components having the same gradation value as a color component of white (W). The WhiteMagic™ function includes a function related to determination of an expansion coefficient value (α). The expansion coefficient value (α) is used for control of gradation values of R, G, B, and W included in the image signals in the RGBW color space, and for the backlight control performed in conjunction with the control of these gradation values.

The following describes processing related to the WhiteMagic™ function. First, the following describes the basic principle of a case in which the combination of the gradation values of R, G, and B represented by the input image signals is converted into the combination of the gradation values of R, G, B, and W. A description will be made below by way of an example of the processing based on an input image signal for one of the pixels Pix.

Assume that the input image signal is an RGB digital signal as described above, and Ro, Go, Bo, and Wo denote signals of respective colors to be displayed by the pixel of RGBW. Then, to prevent the display quality of a displayed picture from changing, the following relation of Expression (1) needs to be satisfied.

$$Ri:Gi:Bi=(Ro+Wo):(Go+Wo):(Bo+Wo) \quad (1)$$

Assume that Max(Ri,Gi,Bi) denotes the maximum value of the signals Ri, Gi, and Bi. Then, the following relations of Expressions (2) to (4) are satisfied. Hence, Expressions (5) to (7) given below are satisfied.

$$Ri/\mathrm{Max}(Ri,Gi,Bi)=(Ro+Wo)/(\mathrm{Max}(Ri,Gi,Bi)+Wo) \quad (2)$$

$$Gi/\mathrm{Max}(Ri,Gi,Bi)=(Go+Wo)/(\mathrm{Max}(Ri,Gi,Bi)+Wo) \quad (3)$$

$$Bi/\mathrm{Max}(Ri,Gi,Bi)=(Bo+Wo)/(\mathrm{Max}(Ri,Gi,Bi)+Wo) \quad (4)$$

$$Ro=Ri\times((\mathrm{Max}(Ri,Gi,Bi)+Wo)/\mathrm{Max}(Ri,Gi,Bi))Wo \quad (5)$$

$$Go=Gi\times((\mathrm{Max}(Ri,Gi,Bi)+Wo)/\mathrm{Max}(Ri,Gi,Bi))Wo \quad (6)$$

$$Bo=Bi\times((\mathrm{Max}(Ri,Gi,Bi)+Wo)/\mathrm{Max}(Ri,Gi,Bi))Wo \quad (7)$$

An assignable value of Wo can be defined as a function of the minimum value Min(Ri,Gi,Bi) of Ri, Gi, and Bi, as given by Expression (8) below, where f is any coefficient. That is, from the simplest point of view, Wo is given by Expression (9) below.

$$Wo=f(\mathrm{Min}(Ri,Gi,Bi)) \quad (8)$$

$$Wo=\mathrm{Min}(Ri,Gi,Bi) \quad (9)$$

Considering Expressions (8) and (9) given above, if the input image signal satisfies Min(Ri,Gi,Bi)=0, then Wo=0. In this case, the luminance of the pixel does not increase. Even if Min(Ri,Gi,Bi)=0 is not satisfied, in a case where Min(Ri, Gi,Bi) is a small value close to 0, the value of Wo is also small, so that the level of increase in the luminance is small.

The DDIC 3 divides a frame image into a plurality of partial regions with respect to the input image signals corresponding to all the pixels constituting the image to be displayed on the display panel, and performs image processing partial region by partial region. Consequently, simply following the basic principle may cause a state in which a part of the picture is excessively bright, and the other part thereof is not bright. Consequently, if, for example, an image includes a part with high saturation (such as a monochromatic part) on a background with low saturation and high luminance, a relatively large value of Wo can be set for the background, but a relatively small value of Wo is set for the part with high saturation.

In general, human sensitivity to (visual characteristics for) color and brightness is greatly influenced by a relative difference in luminance from the surrounding area. Hence, a part having relatively lower luminance (such as the monochromatic part mentioned above) may look dull. This is referred to as what is called simultaneous contrast. Hence, in the present embodiment, color conversion processing is performed to resolve the problem regarding the simultaneous contrast in the image processing of converting the RGB colors represented by the input image signals into the combination of the RGBW colors. This color conversion processing includes arithmetic processing (expansion processing) of improving the luminance of a plurality of pixels constituting an image to be displayed according to image data. The following described the color conversion processing.

The expansion processing of the input image signals will first be described. As represented by Expressions (10) to (12) below, the WhiteMagic™ function expands input image signals Ri, Gi, and Bi so as to maintain the ratio thereof.

$$Rj=\alpha\times Ri \quad (10)$$

$$Gj=\alpha\times Gi \quad (11)$$

$$Bj=\alpha\times Bi \quad (12)$$

To maintain the display quality of the image signals, the expansion processing is desirably performed so as to maintain the ratio (luminance ratio) between the gradation values of R, G, and B. The expansion processing is also desirably performed so as to maintain the gradation-luminance characteristics (gamma) of the input image signals. If the color space after the image processing is the RGB color space, the expansion processing has a limitation. In particular, if a color represented by the input image signal is already a bright color, the input image signal can hardly be expanded in some cases.

In a display apparatus (such as the display apparatus 1) employing the RGBW color space, the addition of W widens the dynamic range of luminance, so that the displayable color space is expanded. The expansion processing is performed up to the upper limit value of the color space of RGB and W components. Consequently, the expansion processing allows the luminance to exceed the limit value 255 in the conventional RGB space.

If, for example, the luminance of the sub-pixel of white (W) is K times the luminance of the sub-pixels of red (R), green (G), and blue (B), the maximum value of Wo can be assumed to be 255×K. In this case, the values (luminance) of Rj, Gj, and Bj can be up to (1+K)×255 in the RGBW color space. As a result, the luminance can be increased even when the data satisfies Min(Ri,Gi,Bi)=0 or small value, which has conventionally been an issue.

Figure 6:
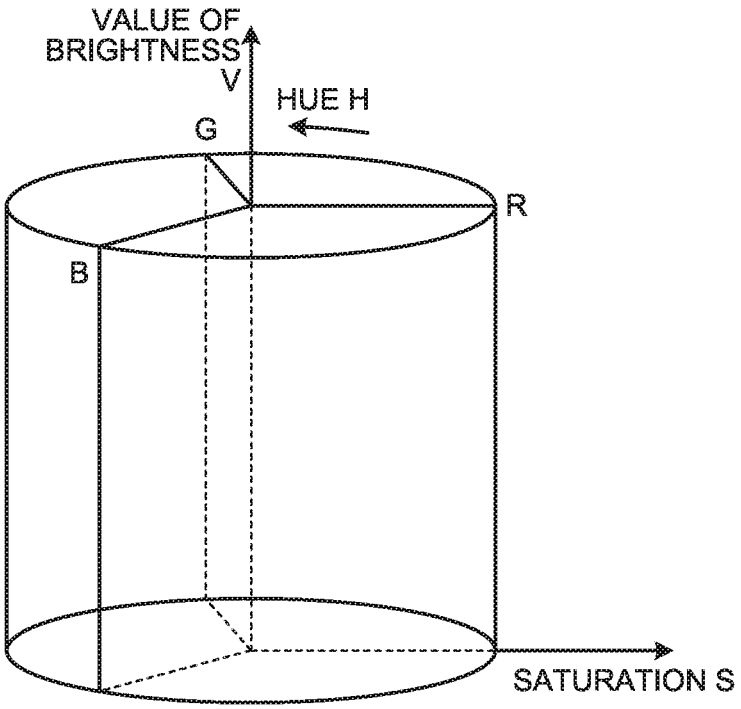
FIG. 6 is a diagram illustrating a color space of an RGB display apparatus.
Figure 7:
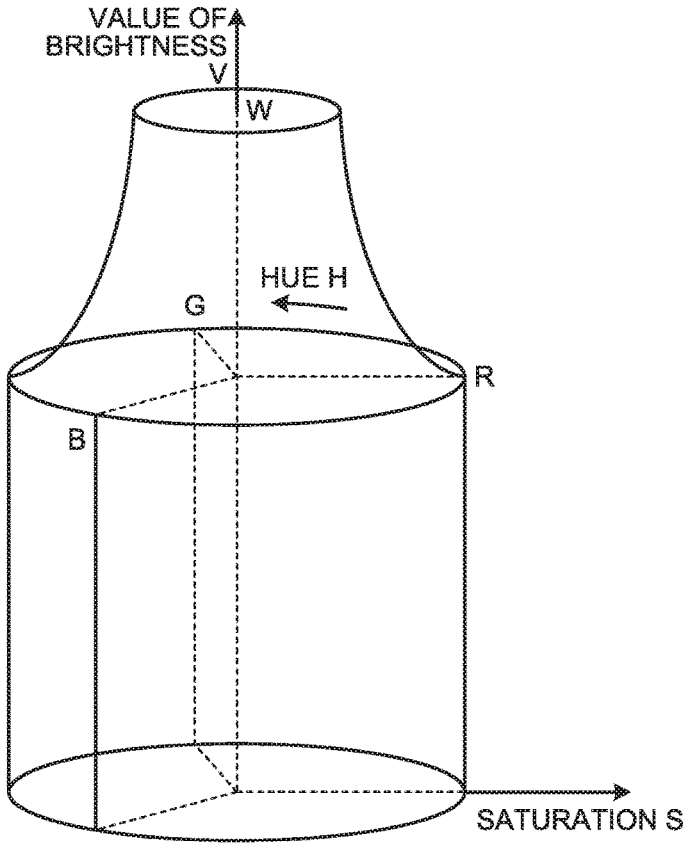
FIG. 7 is a diagram illustrating a color space of an RGBW display apparatus.
Figure 8:
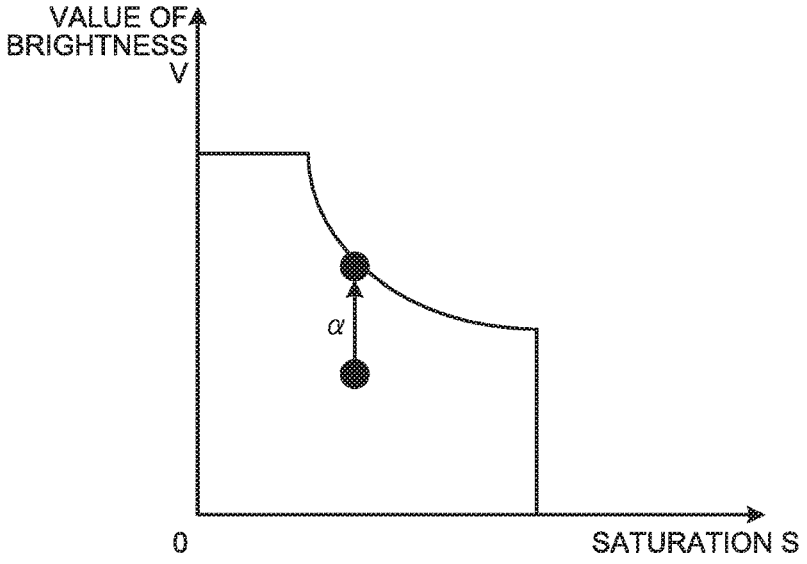
FIG. 8 is a cross-sectional view of the expanded color space of the RGBW display apparatus.

FIG. 6 is a diagram illustrating a color space of an RGB display apparatus. FIG. 7 is a diagram illustrating the color space of the RGBW display apparatus. FIG. 8 is a cross-sectional view of the expanded color space of the RGBW display apparatus. As illustrated in FIG. 6, all colors can be plotted at coordinates defined by hue (H), saturation (S), and value of brightness (V). An HSV color space as one of well-known color spaces is defined by these attributes of hue, saturation, and value of brightness. The hue refers to a difference between colors, such as red, blue, and green, and is an attribute that can best represent differences in impression. The saturation is one of indicators that represents a color, and is an attribute that indicates a level of vividness of a color. The value of brightness is an attribute that indicates a level of brightness of a color. A larger value of brightness represents a brighter color. In the HSV color space, the hue represents R at 0 degrees, and represents G and then B while turning counterclockwise to complete a full circle turn. The saturation indicates how much gray is mixed with each color. The saturation of 0% indicates that a color is murkiest, and the saturation of 100% indicates that a color is least murky. The value of brightness of 100% indicates that a color is brightest, and the value of brightness of 0% indicates that a color is darkest.

As illustrated in FIG. 7, although attributes defining the color space of the RGBW display apparatus are basically the same as the attributes defining the color space of the RGB display apparatus, the addition of W expands the value of brightness. In this manner, the difference in color space between the RGB display apparatus and the RGBW display apparatus can be represented by the HSV color space defined by the hue (H), the saturation (S), and the value of brightness (V). According to this representation, the dynamic range of the value of brightness (V) expanded by the addition of W greatly varies with the saturation (S).

This color conversion processing focuses on the fact that the coefficient α of the expansion processing for the signals Ri, Gi, and Bi serving as the input image signal described above vary with the saturation (S). Specifically, the WhiteMagic™ function analyzes the input image signals, and determines the expansion coefficient value (α) according to the result of the analysis on an image-by-image basis. This processing allows the RGBW display apparatus to display the picture while maintaining the display quality before and after the image processing.

At this time, the expansion coefficient value (α) is desirably determined for each value of the saturation (S) ranging from 0 to the maximum value (255 in the case of an 8-bit value) by analyzing the input image signals. The minimum value of the expansion coefficient values (α) thus obtained may be employed. In this case, the expansion processing can be performed without any loss in the display quality, such that the display quality is maintained before and after the image processing. In the present embodiment, the expansion processing is performed based on a ratio between the Max(R,G,B) value of the input image and a maximum brightness value V in the HSV color space. The ratio is calculated for each of saturation values S from 0 to the maximum value, and the minimum value of the ratios is used as the expansion coefficient value (α) to perform the expansion processing.

To fully maintain the display quality, the input image signals of all pixels constituting one piece of image data are desirably analyzed. To analyze means to perform processing to obtain the Min(Ri,Gi,Bi) and the Max(Ri,Gi,Bi). To increase the processing speed in the color conversion processing and reduce the circuit scale of the functional block 55*c* for performing the WhiteMagic™ function, it is desirable to sample the pixels constituting the image data for each of the partial regions and analyze input image signals corresponding to the sampled pixels. Specifically, the input image signals are analyzed, for example, at intervals of every n pixels (where n is a natural number of 1 or larger). Furthermore, an ergonomic approach can naturally be used as a method for determining the expansion coefficient value (α).

An only slight local change in the signals Ri, Gi, and Bi serving as the input image signals cannot allow human perception. Therefore, the expansion coefficient value (α) is increased to the limit of perception of a change in display quality so that the signals can be expanded without causing a perception of a change in display quality.

As illustrated in FIG. 8, signals (gradation values) after the image processing are generated based on the expansion coefficient value (α) determined by comparing the levels of the input image signals with respect to the expanded RGBW color space.

The following describes a method for determining Wo from the expanded image signals Rj, Gj, and Bj. As described above, the expanded image signals Rj, Gj, and Bj are desirably analyzed to obtain the minimum value Min (Rj,Gj,Bj) of each pixel and to determine Wo to be Min(Rj, Gj,Bj). This is the maximum possible value of Wo. Thus, Wo is determined by analyzing the expanded image signals Rj, Gj, and Bj to obtain the minimum value Min(Rj, Gj, Bj), and setting the result as Wo.

When Wo is determined by the method described above, new RGB image signals are obtained by Expressions (13) to (15) below.

$$Ro=Rj-Wo \tag{13}$$

$$Go=Gj-Wo \tag{14}$$

$$Bo=Bj-Wo \tag{15}$$

Expanding the input image signals with the above-described method can set Wo to a larger value, and thus can further improve the luminance of the entire image. Reducing the luminance of the light source 6 by a factor of 1/α according to the expansion coefficient value (α) can display the image at exactly the same luminance as that of the input image signals. Setting the luminance of the light source 6 to a value larger than that reduced by a factor of 1/α can display the image at a luminance value larger than that of the input image signals.

The gradation values after the expansion processing described above are generated based on the expansion coefficient value (α) determined by comparing the brightness level of the input image signals with respect to the color space formed by the RGBW components. Consequently, the expansion coefficient value (α) is image analysis information obtained as a result of analysis of an image of one frame.

The expansion coefficient value (α) is determined by comparing the brightness level of the input image signals with respect to the color space, and hence does not change even if the image information changes to some extent. For example, even if an image moves about on the screen, the expansion coefficient value (α) remains unchanged unless the luminance or chromaticity greatly changes. Thus, no problem occurs even if the conversion to RGBW is performed using the expansion coefficient value (α) determined for the previous frame.

As described above, according to the present embodiment, whether the level of the power supply voltage of at least one of the functional blocks 55*a*, 55*b*, 55*c*, . . . is high or low is determined based on the predetermined threshold voltage, and if the power supply voltage is determined to be lower than the threshold voltage, the set voltage of the regulator 40 is increased. This approach prevents unnecessary increase in the set voltage, and thereby restrains the power consumption from increasing. This approach can ensure the voltages required to operate the functional blocks 55*a*, 55*b*, 55*c*, . . . by increasing the set voltage as needed. In this manner, according to the present embodiment, the voltages required to operate the functional blocks 55*a*, 55*b*, 55*c*, . . . can be ensured, and the power consumption can be restrained from increasing.

If the power supply voltage is equal to or higher than the predetermined threshold voltage for the predetermined period of time after the set voltage of the regulator 40 has been increased by the voltage controller 65, the set voltage is reduced. As a result, power supply at an unnecessarily high voltage is prevented, and thus increase in power consumption is restrained.

When the set voltage is reduced, the lower limit voltage of the set voltage is the initial set voltage before the voltage controller 65 has increased the set voltage, so that the set voltage is restrained from excessively decreasing.

The set voltage is changed in the predetermined voltage value steps, so that the set voltage can be changed in a stepwise manner.

Modifications

Figure 9:
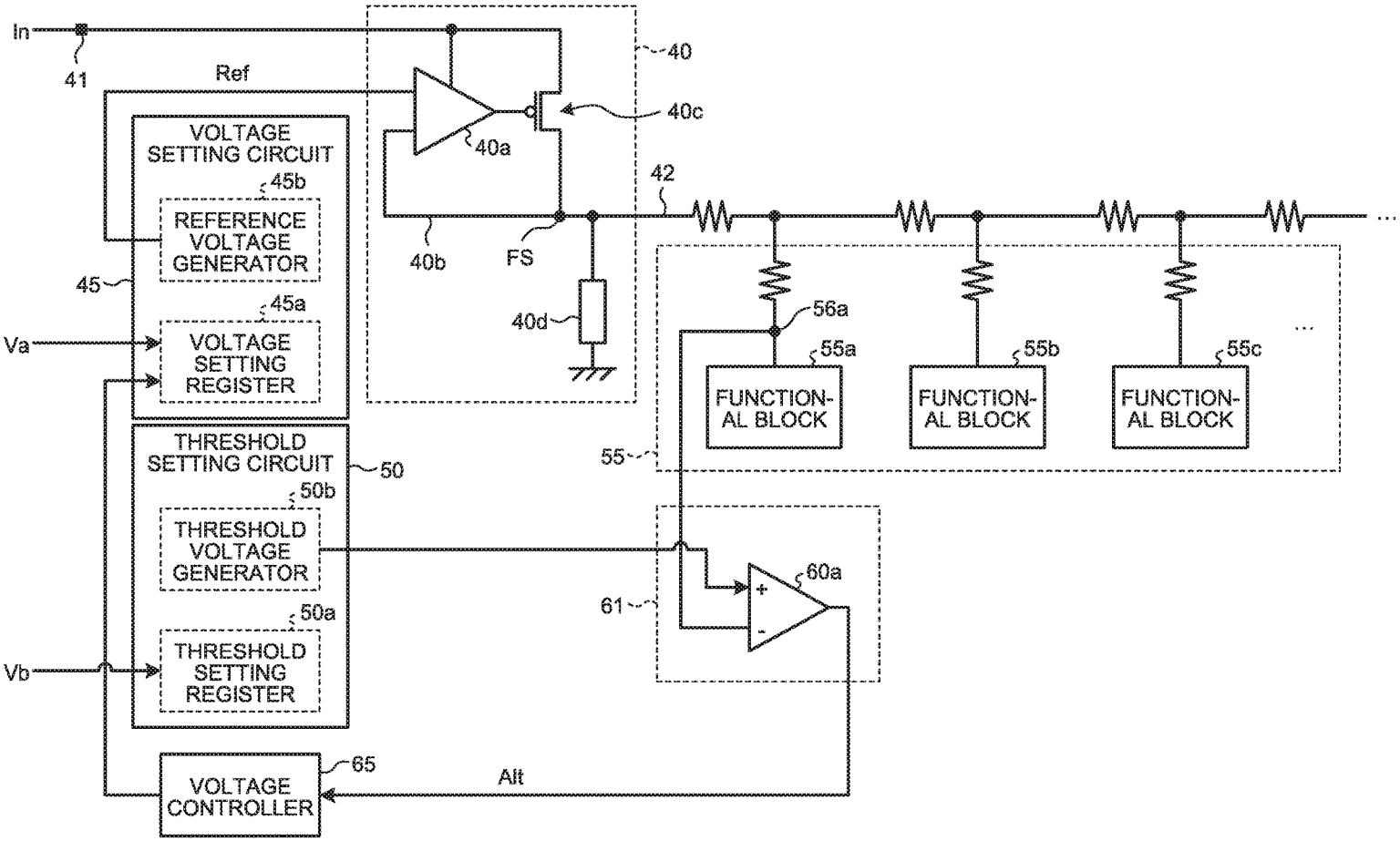
FIG. 9 is a schematic circuit diagram illustrating an example of the regulator and components related to the operation of the regulator according to a first modification of the embodiment.
Figure 10:
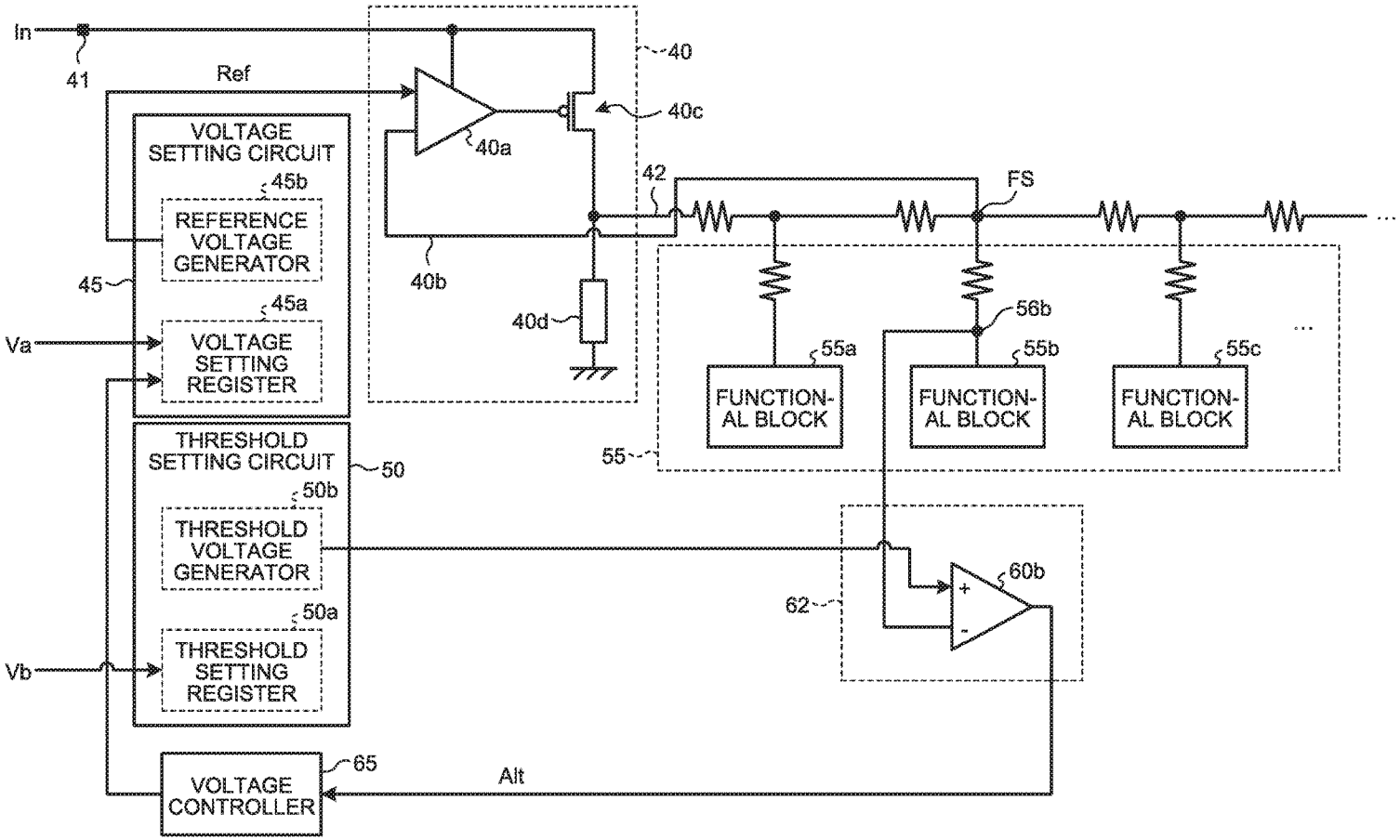
FIG. 10 is a schematic circuit diagram illustrating an example of the regulator and components related to the operation of the regulator according to a second modification of the embodiment.
Figure 11:
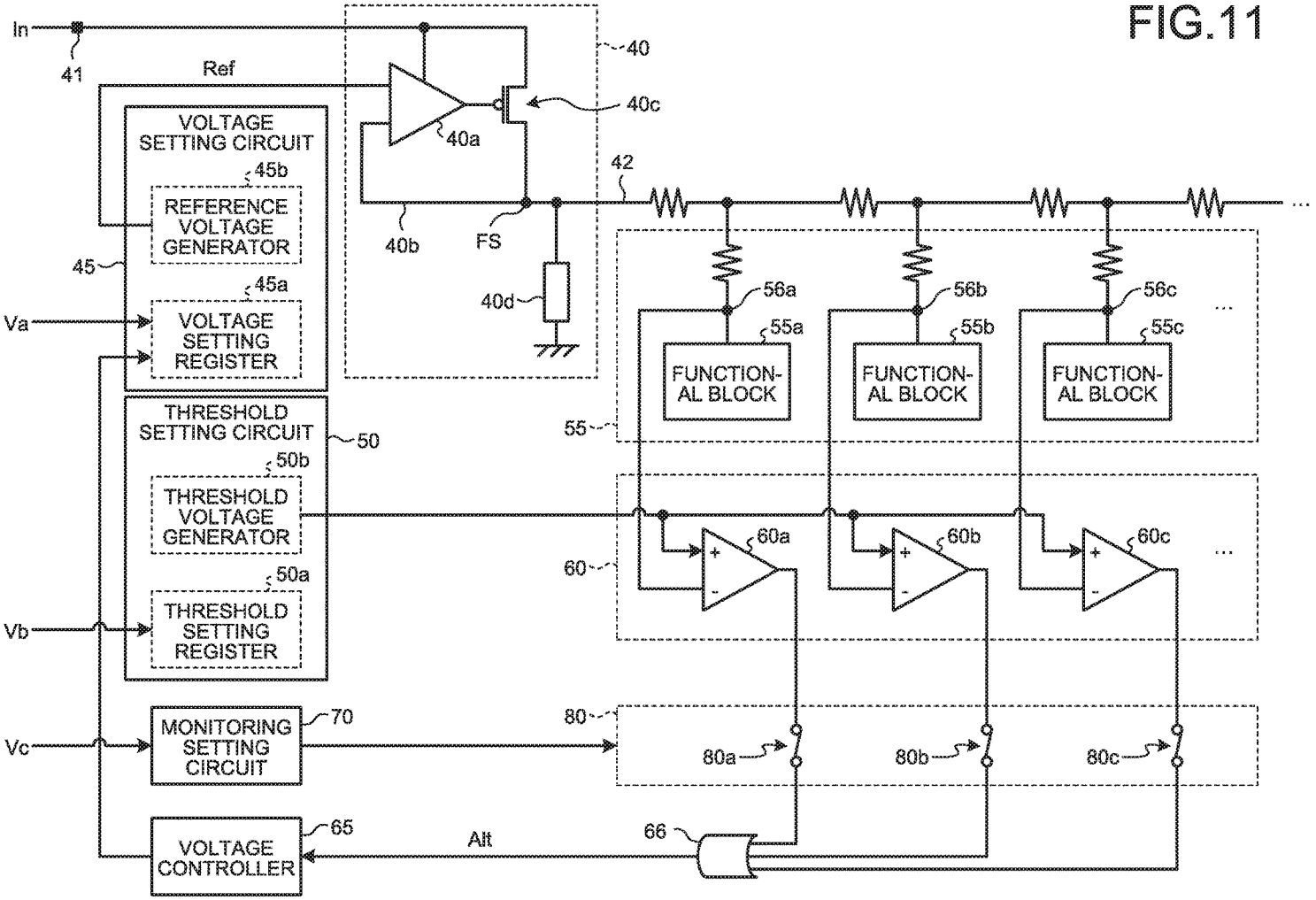
FIG. 11 is a schematic circuit diagram illustrating an example of the regulator and components related to the operation of the regulator according to a third modification of the embodiment.

The following describes modifications of the embodiment according to the present invention, with reference to FIGS. 9 to 11. In the description of the modifications, the same configurations as those in the embodiment described above will be assigned with the same reference numerals, and will not be described in some cases.

First Modification

FIG. 9 is a schematic circuit diagram illustrating an example of the regulator 40 and components related to the operation of the regulator 40 according to a first modification of the embodiment. In the example illustrated in FIG. 4, the comparing circuits 60*a*, 60*b*, 60*c*, . . . are provided for the functional blocks 55*a*, 55*b*, 55*c*, . . . , respectively, and whether the level of the internal logic voltage is higher or lower than the predetermined threshold voltage (Vb) is individually determined at each of all the branch lines. This is, however, merely an example, and the present invention is not limited thereto. For example, a voltage monitoring circuit 61 may be provided instead of the voltage monitoring circuit 60 illustrated in FIG. 4. The voltage monitoring circuit 61 may include a comparing circuit (such as the comparing circuit 60*a*) for determining whether the level of the internal logic voltage relative to the predetermined threshold voltage is high or low based on an output from a branch line coupled with one of the functional blocks 55*a*, 55*b*, 55*c*, . . . (such as the functional block 55*a*), as illustrated in FIG. 9. The voltage control may be performed according to the output (high or low) from the voltage monitoring circuit 61. In this case, a functional block consuming larger power among the functional blocks 55*a*, 55*b*, 55*c*, . . . is the functional block (selection target functional block) that is coupled with the branch line serving as a source of the output to be used to determine whether the level of the internal logic voltage is high or low is, for example. The functional block consuming larger power is a functional block that causes a larger change in the internal logic voltage by being switched between the operational state and the non-operational state, among the functional blocks 55*a*, 55*b*, 55*c*, . . . . The voltage drop due to the parasitic resistance can be reduced by disposing the selection target functional block on the side of the power supply line 42 closer to the regulator 40. The voltage reduced by the power consumption of functional blocks (such as the functional blocks 55*b*, 55*c*, . . . ) other than the selection target functional block and by the parasitic resistance is preferably smaller than the difference between the threshold voltage (Vb) and a minimum voltage (Min) required for the operation of the functional blocks 55*a*, 55*b*, 55*c*, . . . . The configuration described above can ensure the minimum voltage (Min) required for the operation of the functional blocks 55*a*, 55*b*, 55*c*, . . . even if the voltage control according to the functional blocks other than the selection target functional block is omitted. The example illustrated in FIG. 9 is an example of a case where the functional block 55*a* is the functional block that causes a larger drop in the internal logic voltage than the other functional blocks 55*b* and 55*c*. The number of the selection target functional blocks may be greater than one.

Second Modification

FIG. 10 is a schematic circuit diagram illustrating an example of the regulator 40 and components related to the operation of the regulator 40 according to a second modification of the embodiment. In FIG. 4, the junction FS is located at the uppermost branch of the power supply line 42. The location of the junction FS is, however, not limited to this location, but can be appropriately changed, for example, as illustrated in FIG. 10. The junction FS only needs to be located on the power supply line 42 or a branch line branching off the power supply line 42, and may be located at any location to be referenced in the feedback operation with the comparator of the regulator 40. That is, the regulator 40 has the feedback loop 40*b* in the above-described embodiment and the modifications thereof (including the first and the second modifications and the third modification that is described later). The feedback loop 40*b* is a wiring line between the functional blocks 55*a*, 55*b*, 55*c*, . . . and the regulator 40, and is coupled with any one of wiring lines in which the comparator of a voltage monitoring circuit 62 is provided. The regulator 40 is configured to operate according to the result of comparison between the feedback voltage from the feedback loop 40*b* and the set voltage.

The junction FS is located closer to a location of coupling to a functional block (such as the functional block 55*b*) that causes a larger drop in the internal logic voltage associated with the operation. This arrangement facilitates the voltage control according to the level of change in the internal logic voltage associated with the switching between the operational state and the non-operational state of the functional block. The example illustrated in FIG. 10 is an example of a case where the functional block 55*b* is the functional block that causes a larger drop in the internal logic voltage than the other functional blocks 55*a* and 55*c*. In the case of the configuration of FIG. 10, a current flowing through the parasitic resistance of the power supply line 42 between the functional blocks 55*a* and 55*b* increases the logic power supply voltage of the functional block 55*a* to a value higher than the logic power supply voltage of the functional block 55*b*. Accordingly, in this case, the set voltage of the regulator 40 is set such that the logic power supply voltage of the functional block 55*a* falls within an operable voltage range.

As illustrated in FIGS. 9 and 10, when each of the voltage monitoring circuits 61 and 62 includes only one comparing circuit, the OR logic circuit 66 can be omitted. When the OR logic circuit 66 is omitted, the output of one comparing circuit directly serves as the output (Alt) of each of the voltage monitoring circuits 61 and 62. In each of the first and the second modifications, the voltage monitoring circuits 61 and 62 each include one comparing circuit, but may include two or more comparing circuits. In that case, the OR logic circuit 66 is provided in the same manner as in the embodiment describe above. The number of comparing circuits may be smaller than the number of the functional blocks 55*a*, 55*b*, 55*c*, . . . .

Third Modification

FIG. 11 is a schematic circuit diagram illustrating an example of the regulator 40 and components related to the operation of the regulator 40 according to a third modification of the embodiment. The output of a comparing circuit to be employed as the output (Alt) of the voltage monitoring circuit 60 may be selectable from among those from the comparing circuits 60*a*, 60*b*, 60*c*, . . . included in the voltage monitoring circuit 60. Specifically, as illustrated in, for example, FIG. 11, a monitoring setting circuit 70 and a selector 80 may be provided as a configuration of the DDIC 3. The monitoring setting circuit 70 operates the selector 80 according to a setting signal (Vc) that represents a monitoring setting for the voltage and that is output from the control circuit 100 to the DDIC 3. The selector 80 is on a connection path between the voltage monitoring circuit 60 and the OR logic circuit 66. The setting signal (Vc) is, for example, a signal indicating a functional block serving as the selection target functional block. The selector 80 includes a plurality of switches 80*a*, 80*b*, 80*c*, . . . that can individually switch the relation of coupling between the output from each of the comparing circuits 60*a*, 60*b*, 60*c*, . . . and the input to the OR logic circuit 66. Under control of the monitoring setting circuit 70, the selector 80 operates so as to couple the switch of a comparing circuit coupled with a branch line coupled with a functional block that is to serve as the selection target functional block. At the same time, under control of the monitoring setting circuit 70, the selector 80 operates so as to decouple the switch of a comparing circuit coupled with a branch line coupled with a functional block that is not to serve as the selection target functional block. Accordingly, any of the functional blocks 55*a*, 55*b*, 55*c*, . . . can be selected as the selection target functional block. As a result, the number of the components that operate for the voltage control can be further decreased by selecting a functional block corresponding to only a function to be used for the display of the image performed by the display device as the selection target functional block. To prevent the input level of the OR logic circuit 66 from becoming indeterminate when the switch is decoupled, the input level is preferably pulled down, for example, with a resistor.

While the above-described embodiment and the modifications thereof exemplify the DDIC 3 provided in the display apparatus 1, a circuit that performs substantially the same voltage control as that of the DDIC 3 may be used in an apparatus other than the display apparatus. That is, the apparatus other than the display apparatus may include a drive apparatus including the regulator 40, a plurality of functional blocks (such as the functional blocks 55*a*, 55*b*, 55*c*, . . . ), a voltage monitoring circuit (such as any one of the voltage monitoring circuit 60, 61, and 62), and the voltage controller 65. In this configuration, the regulator 40 supplies power based on the predetermined set voltage, the plurality of functional blocks are operated by the supply of the power from the regulator 40, the voltage monitoring circuit determines whether the level of the power supply voltage of at least one of the functional blocks is high or low based on the predetermined threshold voltage, and the voltage controller 65 increases the set voltage when the voltage monitoring circuit determines that the power supply voltage is lower than the threshold voltage.

While the above-described embodiment and the modifications thereof exemplify the liquid crystal display apparatus as the display apparatus, other application examples include, but are not limited to, all flat-panel display apparatuses, such as organic electroluminescent (EL) display apparatuses and other light-emitting display apparatuses. The embodiment and the modifications thereof can be applied to apparatuses in all sizes, such as a small-to-medium-size apparatus, and a large size apparatus.

Other operational advantages accruing from the aspects described above that are obvious from the description in this specification, or that are appropriately conceivable by those skilled in the art will naturally be understood as accruing from the present invention.

What is claimed is:

1. A display apparatus comprising:

a display device that displays an image; and a drive circuit that drives the display device, wherein the display device comprises a regulator that supplies power based on a predetermined set voltage, a plurality of circuit blocks that share the supply of the power from the regulator and control the display device, a voltage monitoring circuit that determines whether a level of a power supply voltage of at least one of the circuit blocks is high or low based on a predetermined threshold voltage, and a voltage controller that increases the set voltage when the voltage monitoring circuit determines that the power supply voltage of the circuit block is lower than the threshold voltage, wherein the voltage controller reduces the set voltage when the power supply voltage is equal to or higher than the threshold voltage for a predetermined period of time after the set voltage has been increased by the voltage controller, and wherein, when the voltage controller reduces the set voltage, a lower limit voltage of the set voltage is an initial set voltage before the voltage controller has increased the set voltage.

2. The display apparatus according to claim 1, wherein the voltage controller changes the set voltage in a predetermined voltage value steps, when changing the set voltage.

3. The display apparatus according to claim 1, wherein the voltage monitoring circuit comprises a plurality of comparators each of which determines whether the level of the power supply voltage is higher or lower than the threshold voltage, and wherein the comparators are provided on respective wiring lines between the respective circuit blocks and the regulator.

4. The display apparatus according to claim 3, wherein the regulator comprises a feedback path coupled with any one of the wiring lines between the circuit blocks and the regulator, and wherein the regulator operates according to a result of comparison between a feedback voltage from the feedback path and the set voltage.

* * * * *